US005243938A

United States Patent [19]

Yan

[11] Patent Number: 5,243,938

[45] Date of Patent: Sep. 14, 1993

[54] DIFFERENTIAL STROKE INTERNAL COMBUSTION ENGINE

[76] Inventor: Miin J. Yan, 4325 Bromyard Ave., Cincinnati, Ohio 45241

[21] Appl. No.: 921,827

[22] Filed: Jul. 30, 1992

[51] Int. Cl.[5] ..... F02B 75/32

[52] U.S. Cl. ..... 123/197.1; 123/71 R

[58] Field of Search ..... 123/197.1, 197.2, 197.4, 123/71 R

[56] References Cited

U.S. PATENT DOCUMENTS

| | | | |
|---|---|---|---|
| 857,410 | 6/1907 | Morey | 123/197.1 |
| 1,134,685 | 4/1915 | Kramer | 123/197.1 |
| 1,413,541 | 4/1922 | Reed . | |
| 1,852,890 | 4/1932 | MacFarlane . | |
| 2,166,464 | 7/1939 | Davis . | |
| 2,731,002 | 1/1956 | Fiala-Fernbrugg . | |
| 4,205,638 | 6/1980 | Vlacancinch | 123/71 R |
| 4,516,539 | 5/1985 | Andreen | 123/71 R |

FOREIGN PATENT DOCUMENTS 615145 10/1926 France .

*Primary Examiner*—E. Rollins Cross
*Assistant Examiner*—Marguerite Macy
*Attorney, Agent, or Firm*—Steven J. Rosen

[57] ABSTRACT

An internal reciprocating engine effective to operate at one engine cycle per revolution is provided with a differential stroke piston having an inner piston part, for sealing the cylinder, operating at a cycle different from its corresponding outer piston part, for transmitting power to and from the engine shaft, and a differential stroke actuating means for operating the inner and outer piston parts in the same and the opposite directions within the cylinder and to provide differential stroke periods and/or stroke lengths for the inner piston part cycle.

43 Claims, 14 Drawing Sheets

DIFFERENTIAL STROKE INTERNAL COMBUSTION ENGINE

BACKGROUND OF THE INVENTION

1. Field of the Invention

This invention relates to internal combustion engines that operate at one complete engine cycle per revolution and has a differential stroke piston means with inner and outer piston parts disposed within a cylinder wherein the inner piston part operates on a different number of strokes per revolution than the outer piston part operates and more particularly to such an engine with an actuation means which provides differential stroke lengths and/or periods of the inner piston part.

2. Description of Related Art

Conventional internal combustion engines have at least one cylinder, a piston in the cylinder, and a crankshaft driven by the piston. Most of these engines operate on a four stroke cycle of the piston per two revolutions of the crankshaft. During the cycle, the piston's strokes are first outward for intake, first inward for compression, second outward (after ignition) for combustion and power, and second inward for exhaust. The burnt gas is driven out during the exhaust stroke and a fresh charge is drawn in during the intake stroke. These two strokes require little force and the piston is subject to low pressures. These two strokes also require one entire revolution of the crankshaft for these purposes.

More output could be obtained from a four stroke engine of a given displacement if it could complete its cycle in only one revolution of the crankshaft. There are conventional two-stroke engines in which the four functions of combustion, exhaust, intake and compression, are crammed into two strokes of the piston per one revolution of the crankshaft. Such two-stroke engines generally weigh less than four-stroke engines but are generally less fuel efficient than four-stroke engines, and hence are conventionally used only in certain special fields, such as small garden engines.

There is a way to combine the advantages of four strokes of the piston with the advantage of one revolution of the crankshaft per cycle and that is to split the piston into an inner part which closes one end of the combustion chamber and a separable outer part which is connected to the crankshaft, and to provide means to move the inner piston part independently of the outer piston part during exhaust and intake. This provides for the inner piston part to operate on the four-stroke principle during a single revolution of the crankshaft, as disclosed in U.S. Pat. No. 857,410 by Morey, Jr., wherein a quarter revolution of meshed gearing is used to operate the piston parts in their different cycles. This design has many problems such as gnashing of teeth when the two gears engage on each revolution of the drive shaft, and a complicated gearing system that is fixed at a four to one ratio that divides the four strokes in equal lengths and periods.

U.S. Pat. No. 1,413,541 by Reed discloses a split piston having a four stroke inner piston part and a two stroke outer piston part (per cycle or engine revolution). Reed also provides an inner piston part that has a cycle with a period for each stroke that is exactly 90 degrees and equal to half the period of a stroke of the outer piston which is 180 degrees. Another limitation of the Reed apparatus includes equal stroke lengths or piston travel for the four strokes of the inner piston part.

U.S. Pat. No. 1,582,890 to MacFarlane has two pistons in a cylinder, which close two chambers. Operating not on a four stroke principle, it uses a cam actuation means to move the inner piston between the two chambers and two sets of ports generally located at opposite ends of its stroke along the cylinder wall. This is to allow the inner piston to pressurize the outer chamber on its downward stroke, which takes a lot of power and strength requiring its actuating apparatus to be unnecessarily heavy and bulky in structure. Furthermore, the outer ports on the cylinder wall limit the inner piston to equal stroke lengths and symmetrical periods.

The four strokes of conventional internal combustion engines each occur during a half turn (180 degrees) of the drive shaft, and thus are equal in lengths and portion of the cycle in which they occur. Similarly, the first two of the above mentioned patents disclose drive connections for the part of the piston that closes the combustion chamber so that it must move in four equal strokes, each completed during a quarter turn (90 degrees). The MacFarlane patent expressly discloses cylinder ports which the inner piston must cover during combustion and final compression of the combined charges from both cylinder chambers, so that these two strokes are limited to equal lengths and shaft turns.

SUMMARY OF THE INVENTION

The present invention provides a differential stroke piston apparatus for reciprocating internal combustion engines having a piston means disposed within a cylinder including an inner piston part which closes and seals the cylinder chamber and an outer piston part which serves as a carrier for the inner piston part and is connected to the engine shaft, preferably a crankshaft. The inner piston part is effective to operate on a cycle different from that of the outer piston, for example four strokes for the inner piston part and two strokes for the outer piston part per revolution of the engine. The present invention also provides a differential stroke cycle means to vary the stroke period and/or stroke length of the inner piston part cycle.

The preferred embodiment provides a differential-four-stroke inner piston part and an outer piston part that is connected by a connecting rod to a crankshaft during the whole cycle. The two piston parts combine to ride on the connecting rod during the power and compression portions of the cycle, when compression forces are at their highest levels. During the exhaust and intake portions of the cycle, when compression forces are much lower, the inner piston part executes an inward and outward movement that are exhaust and intake respectively, independently of the outer piston part which continues to move connected to the connecting rod.

The present invention provides several advantages over the prior art. The differential stroke means provides greater flexibility to fine tune the engine design in order to obtain greater overall engine efficiency, a more efficient combustion cycle, and lower levels of pollution emissions. One embodiment provides a unsymmetrical cam means for the differential stroke means that may be used to vary the stroke periods and/or stroke lengths of a cycle (one engine or engine shaft revolution) of the inner piston part. Because the camming cannot be varied during engine operation, this particular embodiment is referred to as a differential stroke means. By designing the cammed actuating apparatus so that the inner piston part and its actuating apparatus can be lighter in weight, less complicated, and technically and commercially more feasible than the prior art designs.

Another embodiment provides a variable cycle differential stroke engine wherein a variable cycle actuation apparatus is used instead of the cammed actuating apparatus to operate the inner piston part and the stroke length and or period may be varied during engine operation. Such a variable cycle actuation apparatus may be electrically, pneumatically, or hydraulically powered and controlled by a controller similar to digital electronic controllers used on present day automobiles.

Additional features and advantages of the present invention include a mating means for properly seating and providing load transmission between the piston parts and the connecting rod. The mating arrangement enables strong components to be placed in the crowded space within the differential stroke piston so that strain and wear is reduced for more reliable operation.

A lever means, preferably using a four-bar linkage, for linking the inner piston part to auxiliary driving means when the inner piston part is separated from the outer piston part. The linked lever means translates and amplifies a small driving motion into a substantially linear larger motion where the lever means engages the inner piston part. It also allows the auxiliary driving means to be placed away from the crowded area of the engine beneath the piston. This provides a wider range of choices and an easier design for the driving means that actuates the lever, such as electrical, hydraulic, mechanical and the like.

Another feature of the preferred embodiment is a mechanical rocking means as the auxiliary driving means for the inner piston part driven directly from and automatically synchronized with the drive shaft. This permits means integral with the drive shaft to operate the inner piston part. Such means can be formed on the balancing weights of a crankshaft, thus making use of what is already present in a conventional engine.

Another feature is a connecting rod means that accommodates the piston stem, the piston mating means and the lever means to facilitate heavy load transmission between the cylinder and the engine shaft. Another feature is a single cam on the drive shaft to operate both the intake and exhaust valves.

While the invention is primarily concerned with engines whose pistons are connected to crankshafts, it is also applicable to other drive connections to pistons (e.g., wobble plate designs). The invention is applicable to diesel as well as spark-fired engines.

BRIEF DESCRIPTION OF THE DRAWINGS

The novel features believed characteristic of the present invention are set forth and differentiated in the claims. The invention, together with further objects and advantages thereof, is more particularly described and semi-schematically illustrated in conjunction with the accompanying drawings in which:

DETAILED DESCRIPTION OF THE PREFERRED EMBODIMENT

Figure 1A:
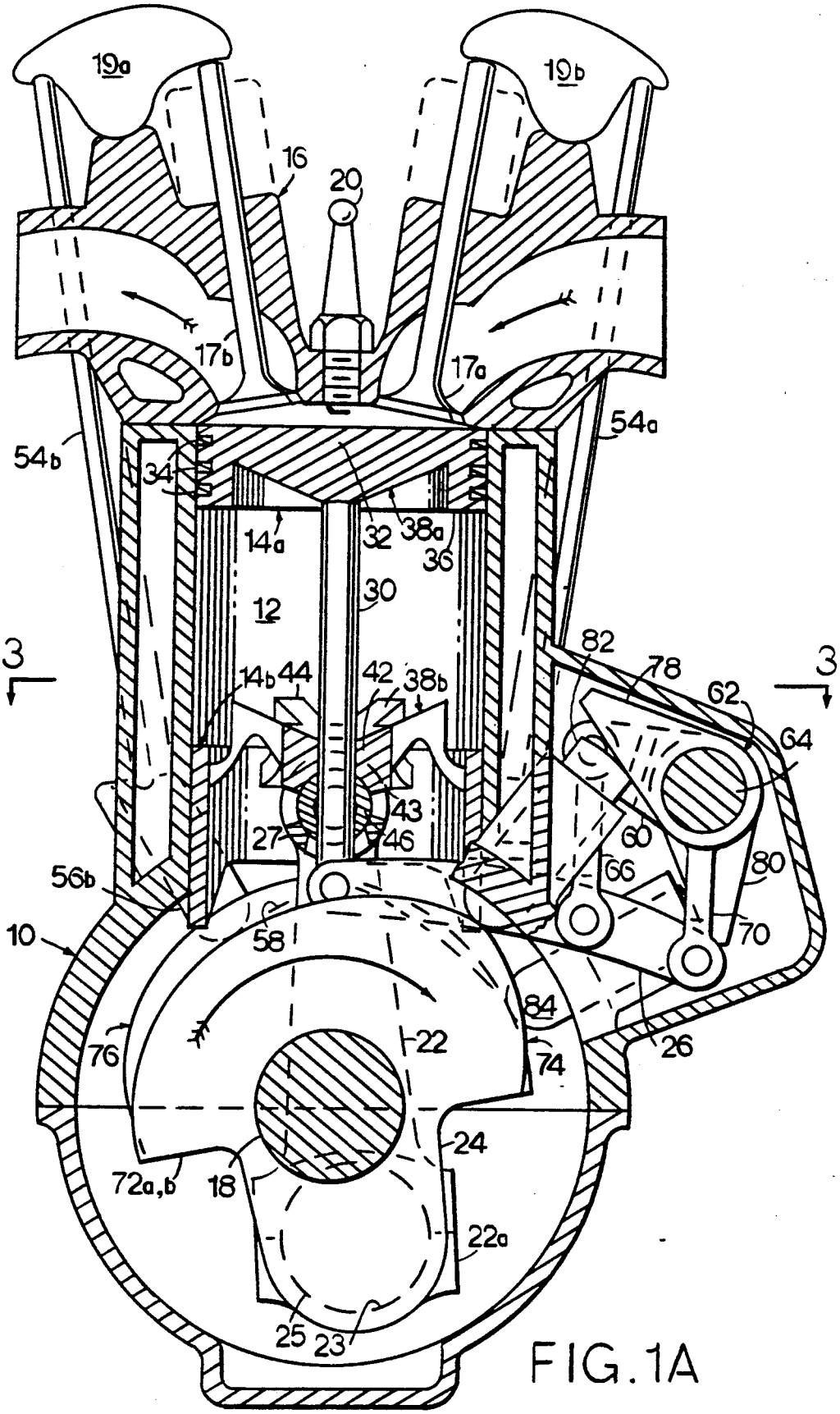
FIG. 1A illustrates a section normal to the axis of rotation of the drive shaft of an engine embodying the invention, said section also extending through the central axis of a differential stroke piston in the engine while the inner piston part is at the top of its stroke.
Figure 1B:
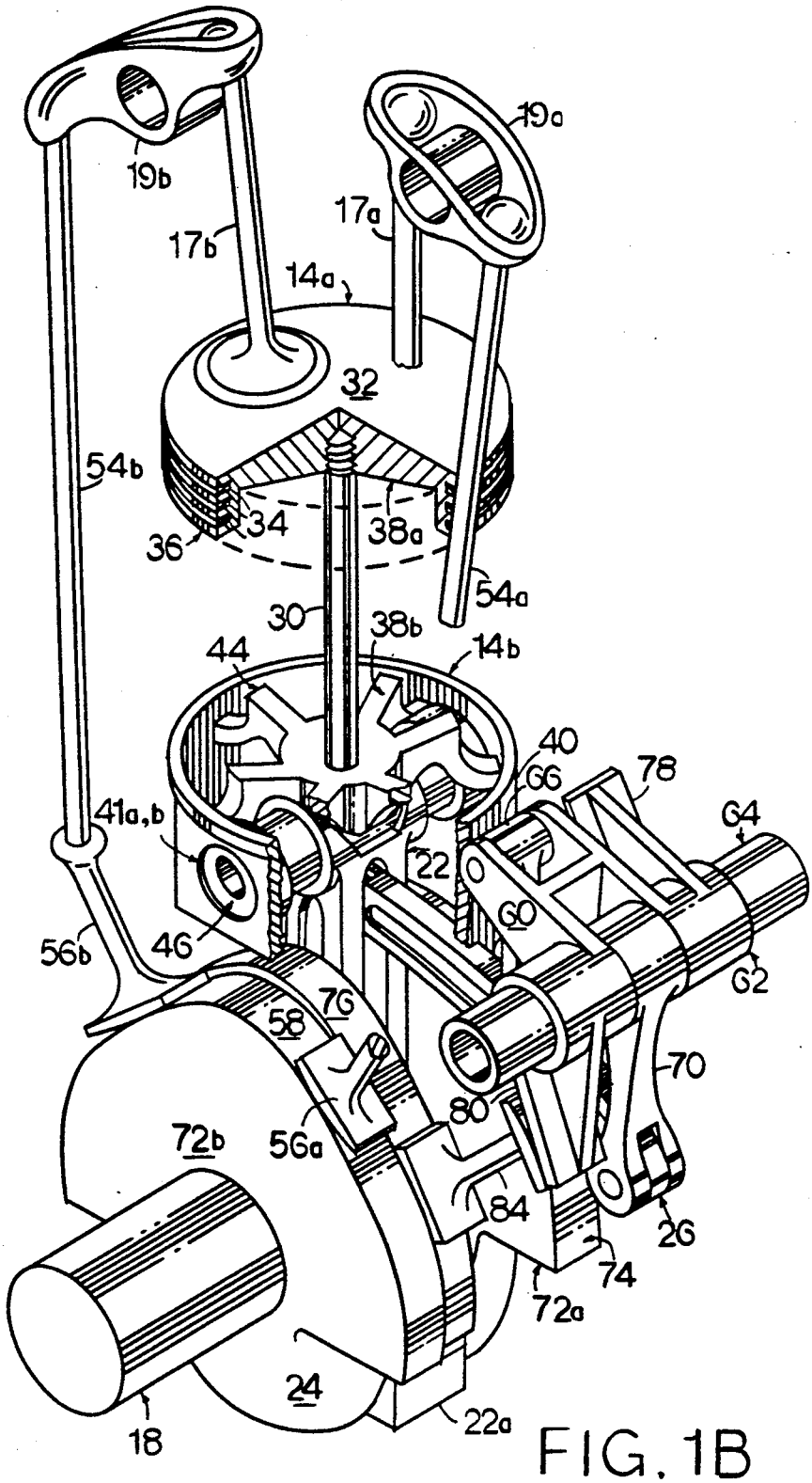
FIG. 1B is a perspective view of a differential stroke piston engine assembly showing the inner and outer piston parts in separated positions in accordance with the preferred embodiment of the present invention.
Figure 2:
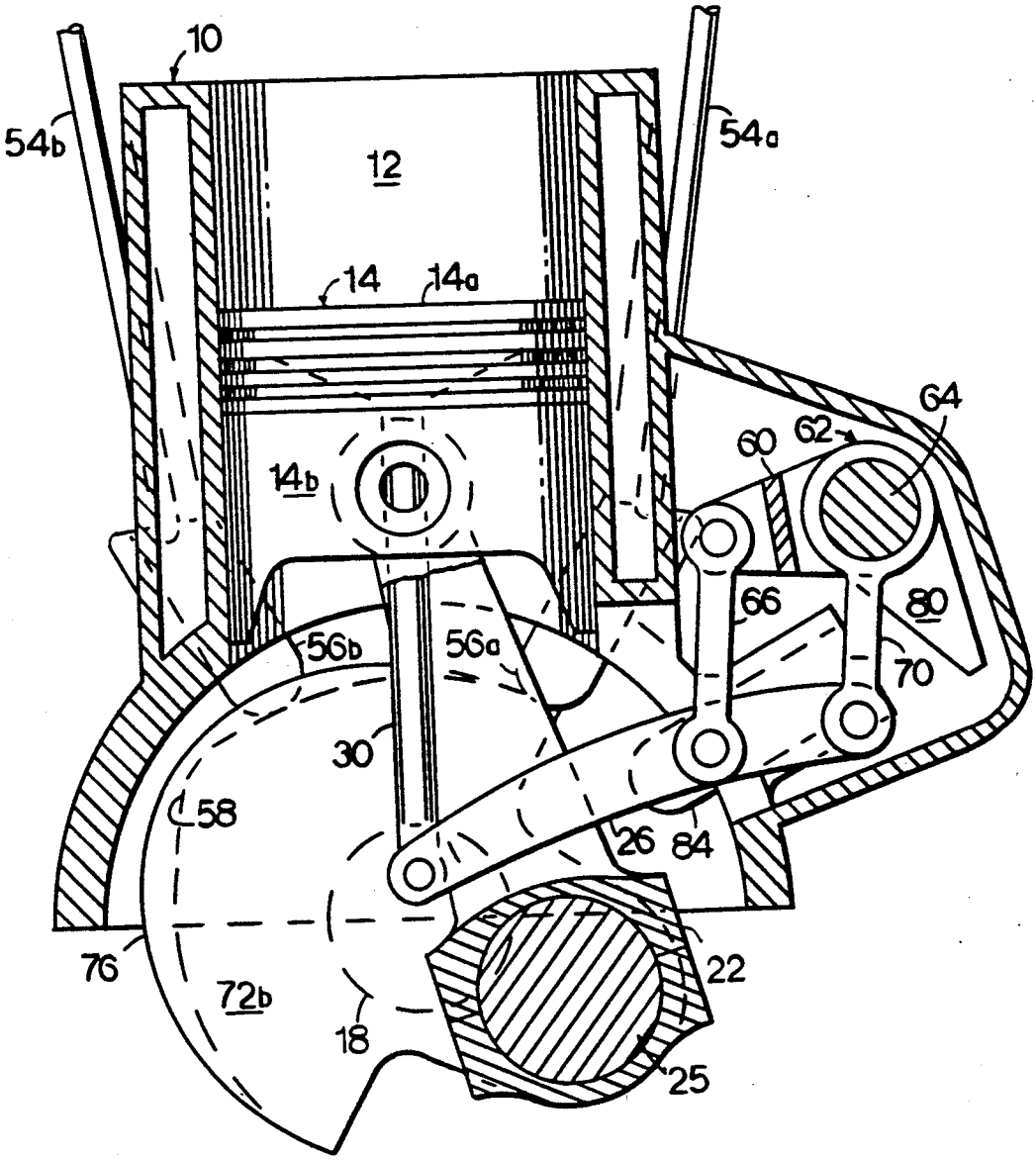
FIG. 2 shows a broken-away part of the section shown in FIG. 1A while the differential stroke piston is at the bottom of its stroke and the inner and outer piston parts are in their mated positions.
Figure 3:
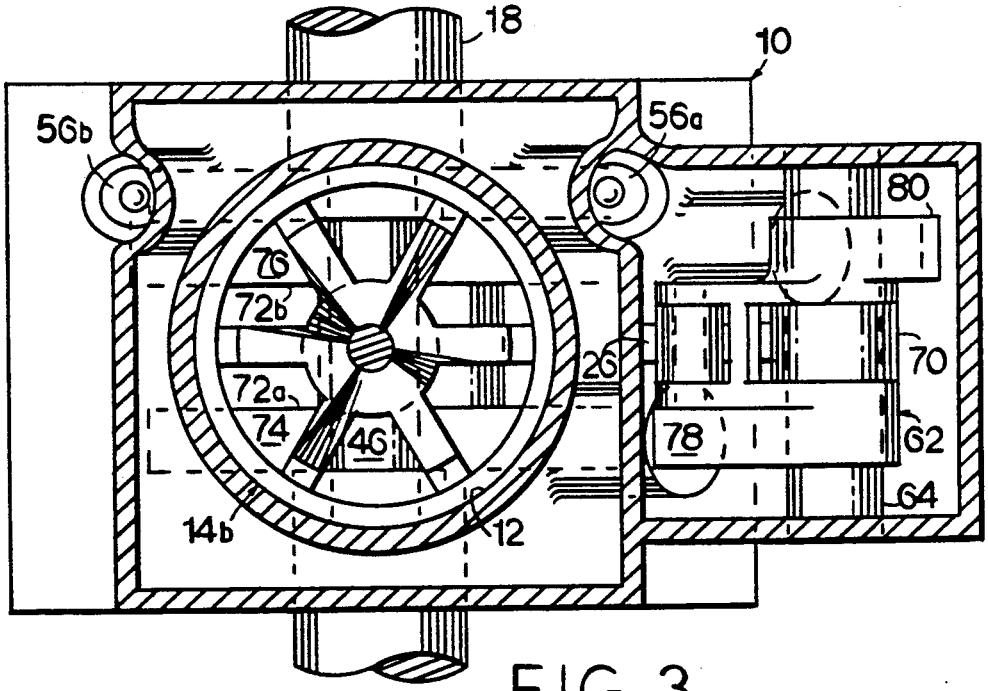
FIG. 3 shows a top sectional view partially broken away through 3—3 in FIG. 1A with the connecting rod removed.

Referring now more particularly to the drawings, and initially to FIGS. IA, IB, 2 and 3, the illustrated engine 10 has a fixed cylinder wall 12 in which a differential stroke piston 14 moves between a fixed cylinder head 16 above and a rotating crankshaft 18 below, referring to the orientation of the engine shown in FIG. 1A. Charging and exhausting cylinder 12 is controlled by intake valve 17*a* and exhaust valve 17*b* respectively. Combustion is initiated by a spark plug 20 (not used in diesel applications) in cylinder head 16. Engine 10 is operable to complete one full combustion cycle per engine revolution.

The differential stroke piston 14 has an inner piston part 14*a* which closes and seals the combustion chamber and an outer piston part 14*b* which is connected by a connecting rod 22 to the crankshaft 18 and also serves as a carrier for the inner piston part during portions of its cycle. The embodiment illustrated herein provides for inner piston part 14a to operate on four strokes per cycle and outer piston part to operate on two strokes per cycle. During the exhaust and the intake portions of the cycle, the piston parts 14a and 14b separate. During separation inner piston part 14a is actuated and driven through a separate set of connections, generally referred to as a lever means, herein, and denoted by and including a lever bar 26 pivotally connected by a pin 28 to a stem 30 attached to inner piston part 14a such that inner piston part 14a provides the load for the lever bar. Meanwhile outer piston part 14b is functionally idle but continues to move under control of crank arm 24 and connecting rod 22.

Figure 4:
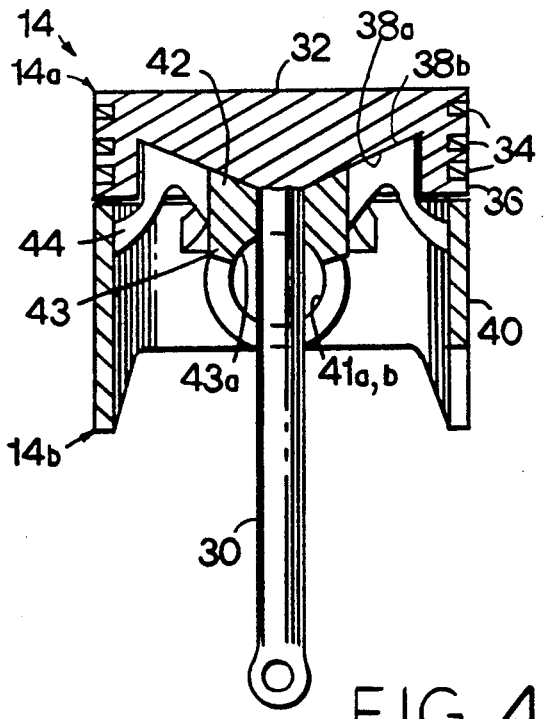
FIG. 4 shows a partial front sectional view of the two piston parts pressed together for the engine shown in FIG. 1A.
Figure 6:
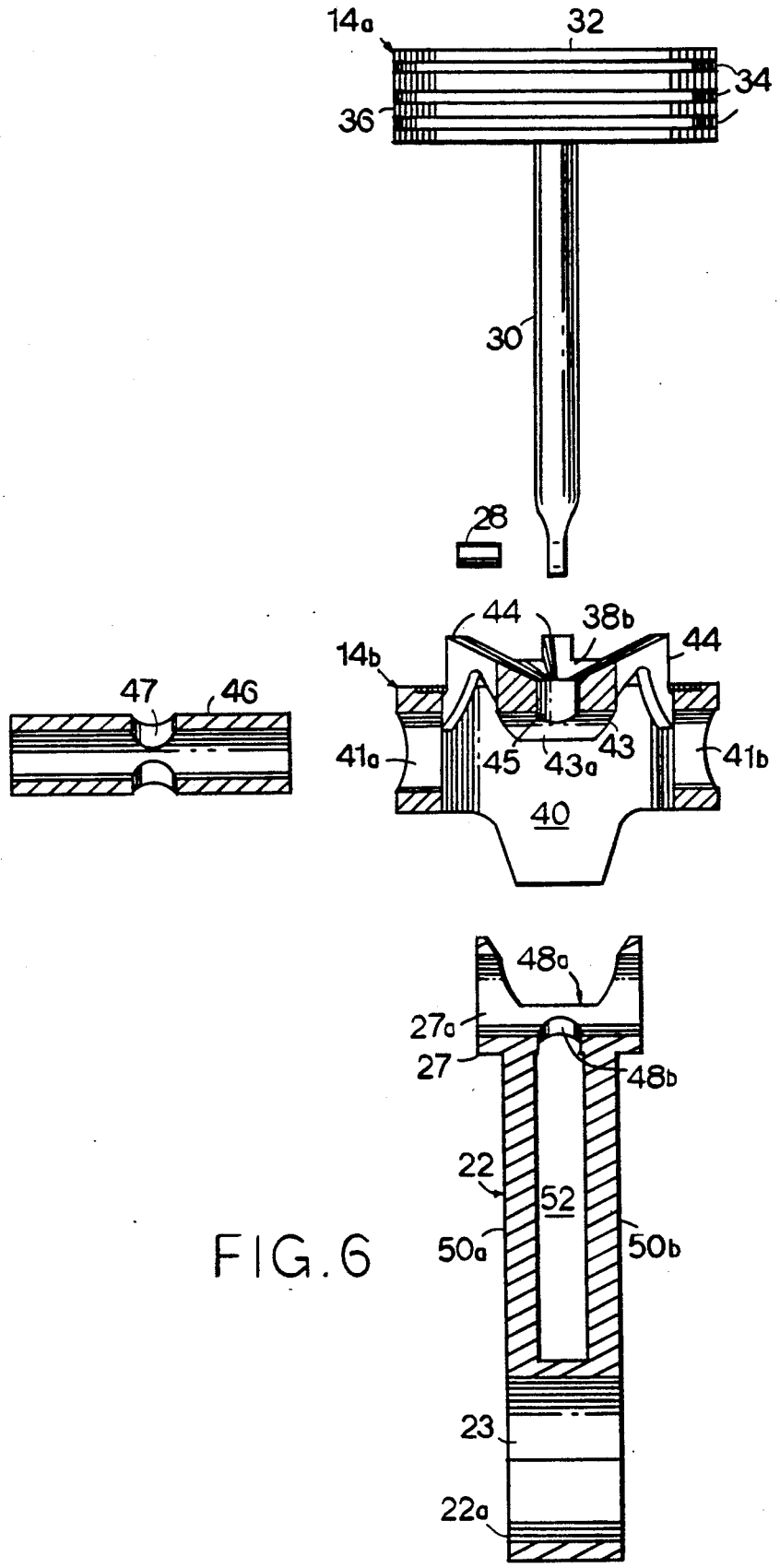
FIG. 6 shows an exploded view of the inner and outer piston parts, pin, and connecting rod in accordance with the preferred embodiment of the present invention shown in FIG. 1A.
Figure 7:
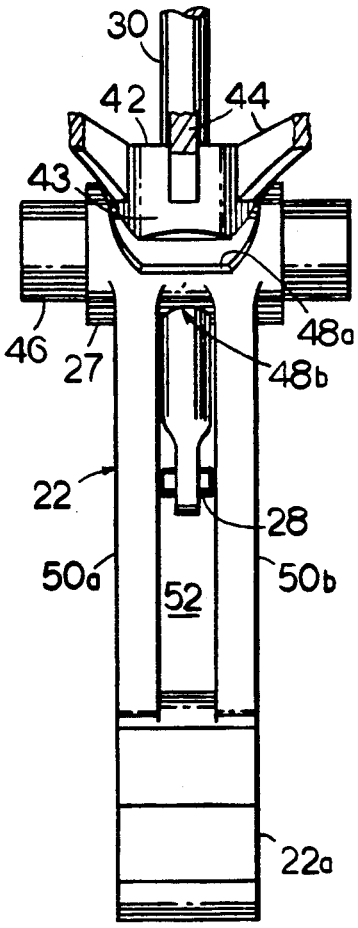
FIG. 7 shows a side view of the piston stem, pin, connecting rod and inner piston saddle with struts partially cut away of the assembly shown in FIG. 6.
Figure 8:
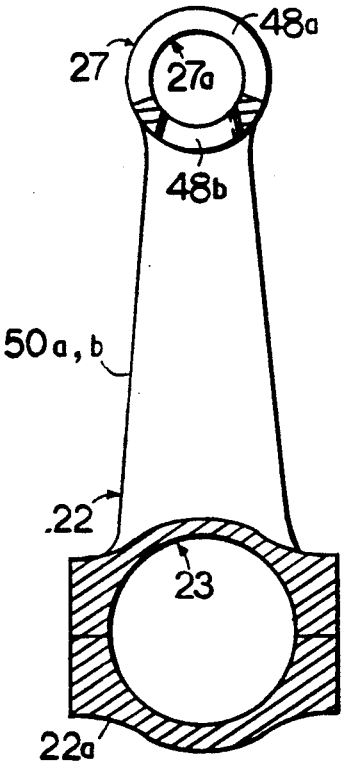
FIG. 8 shows a front sectional view of the connecting rod shown in FIG. 7.
Figure 9:
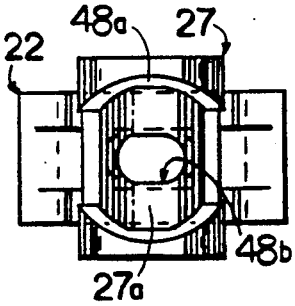
FIG. 9 shows a top view of the connecting rod shown in FIG. 8.

Referring to FIGS. 4 and 6, inner piston part 14a has a solid crown 32 to close the combustion chamber and rings 34 around its periphery to pressure seal its sliding engagement with the cylinder wall 12. Crown 32 can include a cylindrical skirt 36, next to cylinder wall 12, and an outwardly tapering convex conical surface 38a extending from skirt 36 to stem 30. The convex conical surface 38a may be continuous, as shown, or may be discontinuous having ribs and rings that mate with struts 44 of outer piston part 14b as described below. Stem 30 is substantially concentric with the central axis of cylinder wall 12 and the convex conical surface 38a.

Note that stem 30 has an optimum position, that lies along the reaction line of the friction force from the wall and the inertia force of the inner piston part. If the inner piston part is symmetric, the reaction line is in line with the axis. Otherwise, there will be a slight eccentricity between these two lines. Some pistons have a combustion bowl that makes the reaction line not coincide with the axis of the piston.

Figure 5:
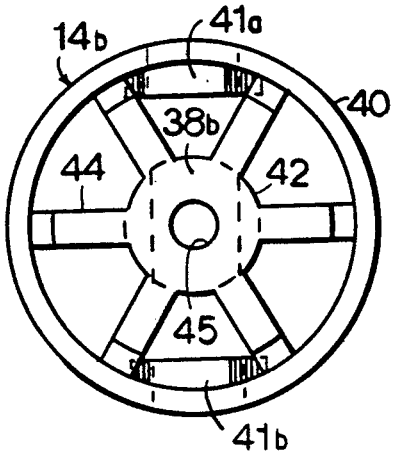
FIG. 5 shows a top view of the outer piston part in accordance with the preferred embodiment of the present invention shown in FIG. 1A.

Referring to FIGS. 4, 5 and 6, outer piston part 14b has a hollow cylindrical outer skirt 40 slidable along cylinder wall 12, a hub like saddle 42 and a series of struts 44 integrally extending from saddle 42 to outer skirt 40, and a cylindrical wrist pin 46. The seat (upper surface) of the saddle 42 and radial struts 44 define a concave conical surface 38b adapted to mate with the convex conical surface 38a of inner piston part 14a as in a male to female element relationship. The base angle of the convex and concave conical surfaces 38a and 38b respectively is preferably not less than half of the swing angle of the connecting rod at the opposite ends of its pivotal movement about the wrist pin 46. This will insure the resultant loads from gas pressure and cylinder wall thrust be channelled toward the saddle 42.

The cylindrical wrist pin 46 extends parallel to the axis of crankshaft 18 and is mounted in outer piston part 14b, by inserting it endwise through and securing its ends in skirt apertures 41a and 41b through opposite sides of skirt 40. The saddle 42 has an axial bore 45 through its center which is configured to operably allow stem 30 to pass through the axial bore 45. The saddle 42 has a concave semi-cylindrical saddle bottom surface 43a, that fits snugly against a portion of the upper surface of wrist pin 46 midway between the ends of wrist pin 46. This snug fit is preferably achieved by forming saddle bottom surface 43a when forming the skirt apertures 41a and 41b that receive wrist pin 46. The integral upper end of connecting rod 22 is bored or cast to extend in sliding engagement around wrist pin 46 on opposite sides of saddle skirt 43, in order to pivot on wrist pin 46 during rotation of crank arm 24.

The axes of wrist pin 46 and stem 30 intersect at right angles. Wrist pin 46 has a substantially larger outer diameter than stem 30, and has a transverse bore 47 through which it slidably receives stem 30. Wrist pin 46 thus braces stem 30 against side thrusts, but does not interfere with lengthwise movement of stem 30 during periods of relative movement between inner and outer piston parts 14a and 14b respectively. Stem 30 extends and retracts through the bore 45 of saddle 42 and its saddle skirt 43 (and also transversely through the middle of wrist pin 46 as hereinbefore described), thus being slidably entirely through outer piston part 14b and its wrist pin.

Connecting rod 22, preferably a one-piece integral construction except where it has a half cylindrical cap 22a bolted (bolts not shown) on its lower end bearing 23, which is journaled on the crank pin 25. The upper and lower ends of connecting rod 22 are connected by a pair of parallel integral legs 50a and 50b. An elongated space 52 between legs 50a–50b provides clearance for stem 30 and the connected end of lever bar 26 during engine operation. A slot 48b through the bottom wall of upper end bearing 27 of connecting rod 22 extends down from an upper end bearing transverse bore 27a to the upper end of space 52 to provide clearance for stem 30 to extend beneath wrist pin 46 into the space 52 while connecting rod 22 pivots back and forth on wrist pin 46 during rotation of crank arm 24. Suitable bearing materials (not shown) can also be placed between the bearings of the connecting rod and the wrist pin 46 and crank pin 25, respectively.

Referring to FIGS. 6 through 9, the integral upper end of connecting rod 22 is shown with the upper end bearing 27 with its upper end bearing transverse bore 27a and rotatably connected to outer piston part 14b by wrist pin 46. Wrist pin 46 is emplaced by inserting it endwise through one of the skirt apertures 41a and 41b through the side of skirt 40, and then through bore 27a and into the other one of skirt apertures 41a and 41b. A notch 48a extends down through the top of the central portion of the upper end bearing 27, into bore 27a. This provides an opening through which saddle skirt 43 of outer piston part 14b passes through the top of connecting rod 22 to engage the upper side surface of wrist pin 46. The pressure on inner piston part 14a during combustion is thus transmitted to outer piston part 14b (through their engaging conical surfaces), thence by outer piston part 14b to wrist pin 46 (primarily where saddle skirt 43 engages wrist pin 46, with little or no pressure by outer piston part 14b on the ends of wrist pin 46 in housing openings 41a and 14b), thence by wrist pin 46 to the upper end bearing 27 of connecting rod 22 (where pin 46 engages bore 27a), and thence from the lower end bearing 23 to crank pin 25. These pressures are transmitted in reverse during compression.

Figure 10:
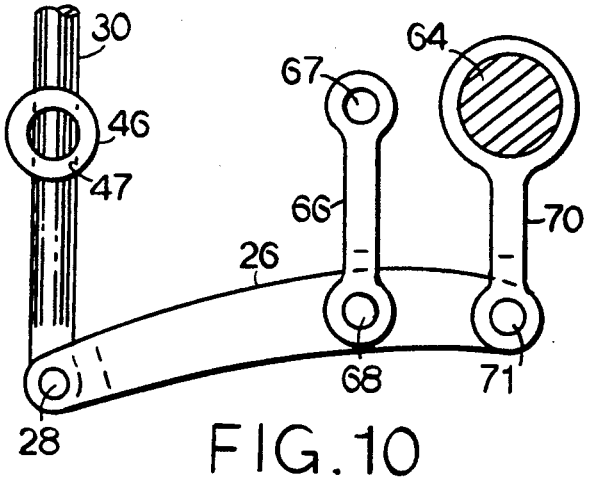
FIG. 10 shows a front sectional view of the lever bar with its linkage to the inner piston stem shown in FIG. 1A.

Referring to FIG. 10, lever bar 26 is pivotally supported at one end by a support bar 70, acting as a fulcrum for the lever means, via pin 71 and support bar 70 is pivotally mounted on a rocker assembly shaft 64. An actuating link 66 pivotally links the lever bar 26, via a pin 68, to a lever actuating means (not shown in FIG. 10), via a pin 67 which provides the force for the lever means. When the lever actuating means pulls or pushes on pin 67, it moves the stem 30 upward or downward. This is because the wrist pin 46 permits only end wise motion of the piston stem 30 and the support bar 70 provides a swinging fulcrum to the lever bar 26. The lever actuating means can be electrical, hydraulic, or mechanical, synchronized with the crankshaft rotation.

Figure 11:
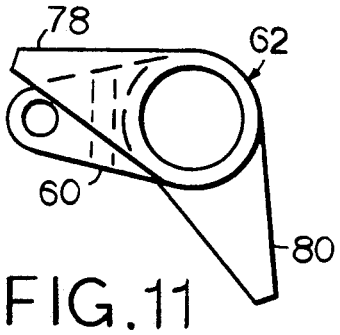
FIG. 11 shows a front sectional view of the rocker assembly shown in FIG. 1A.
Figure 12:
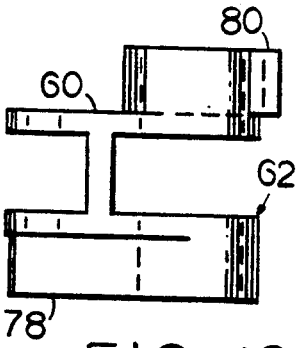
FIG. 12 shows a top view of the rocker assembly shown in FIG. 11.
Figure 13:
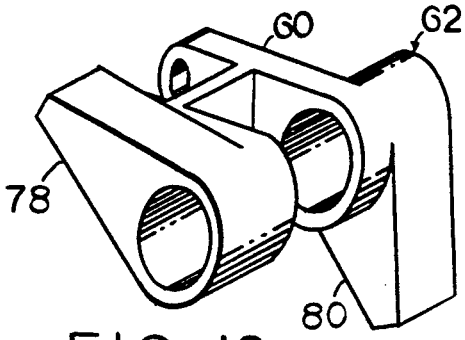
FIG. 13 shows a perspective view of the rocker assembly shown in FIGS. 11 and 12.

It is preferable to operate the lever bar 26 mechanically via a rocker assembly 62 driven by cams on the balancing weights of the crankshaft 18 as shown in FIGS. IA, IB, 2, and 3. Referring to FIGS. 11, 12 and 13, the rocker assembly 62 include a rocker bar 60 which is pivotably connected to the actuating link 66 via pin 67, an exhaust arm 78, and an intake arm 80. The rocker assembly 62 is preferably a one-piece construction and is pivotably mounted on the rocker assembly shaft 64. The rocker bar 60, actuating link 66, support bar 70 and lever bar 26 form a four-bar linkage. Rocking of the rocker assembly 62 moves the inner piston part 14*a* up and down with no lateral movement of stem 30 and little lateral thrust against it from lever bar 26. The four-bar connection requires relatively small space (as shown in FIGS. 1A, 1B, 2 and 3), and it translates a small rotational movement of the rocker bar 60 into a much larger endwise movement of the stem 30.

Figure 14:
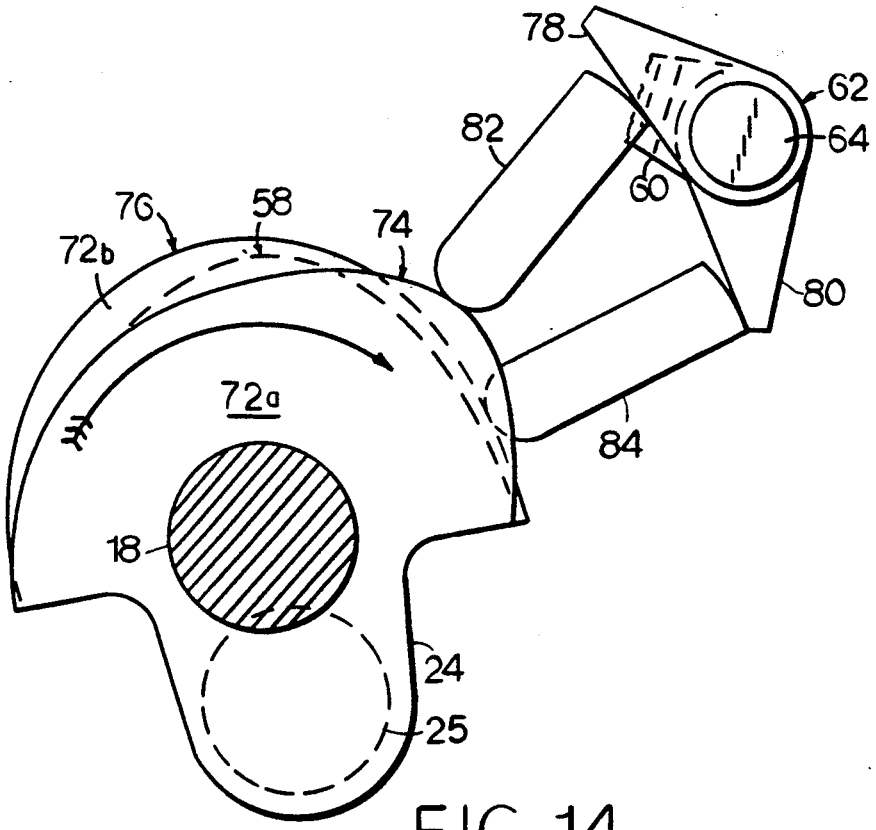
FIG. 14 shows a front view of the rocker assembly operated through the piston lifters riding on the piston cams on the balancing weights.
Figure 15:
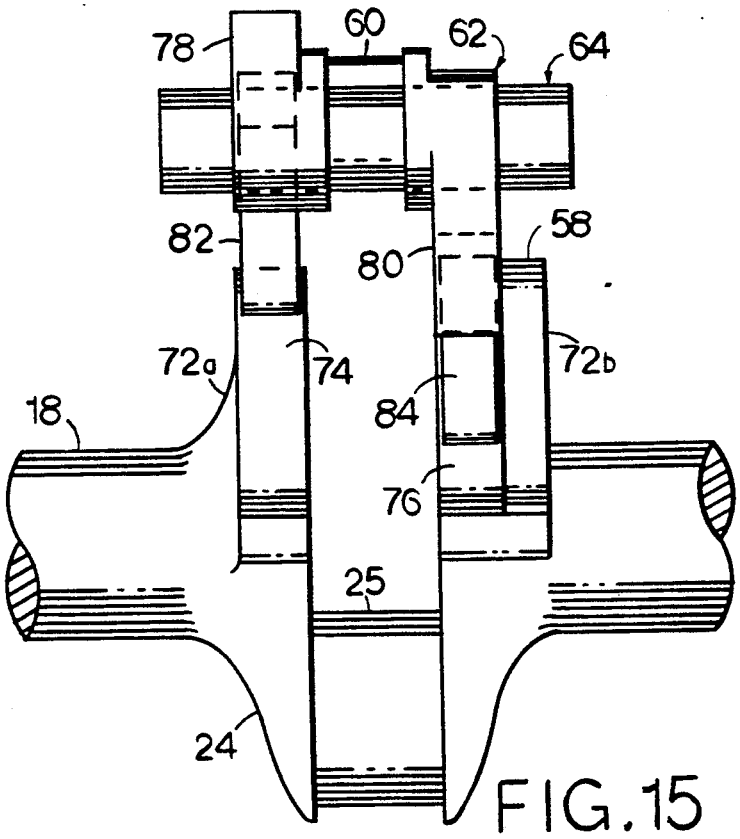
FIG. 15 is a partial side view of the rocker assembly shown in FIG. 14.

Referring now to FIGS. IB, 14, and 15 a pair of counterweights 72*a* and 72*b* are fixed on crankshaft 18 on the two spaced apart sides which extends radially in the opposite direction from crank arms 24. A pair of exhaust and intake cam tracks 74 and 76 respectively are attached to, preferably integral with, corresponding counterweights 72*a* and 72*b* respectively, and extend along their outer peripheries. Each cam track has an active ascending leading profile, preferably for about 60 degrees, rising to its highest radius followed by a passive descending trailing profile. The leading profiles of exhaust and intake cam tracks 74 and 76 operate to turn rocker assembly 62, and one clockwise and the other counterclockwise. The height of the cam profiles are determined by and designed to allow inner piston part 14*a* to reach its inner-most position in exhaust strokes and to allow it to joint the outer piston part 14*b* at the end of intake strokes. Rocked by the rocker assembly 62, the distal ends of exhaust and intake arms 78 and 80 respectively bear, in succession, against the outer ends of a pair of exhaust and intake piston lifters 82 and 84 respectively whose inner ends engage cam exhaust and intake tracks 74 and 76 respectively as shown in FIG. 14. Each of the exhaust and intake piston lifters 82 and 84 can be spring loaded (not shown) and biased inwardly to be ready to engage the exhaust and intake cam tracks 74 and 76 when brought together by the revolution of crankshaft 18. The trailing profiles of exhaust and intake cam tracks 74 and 76 guides the corresponding exhaust and intake piston lifters 82 and 84 back to their inward positions.

Figure 16A:
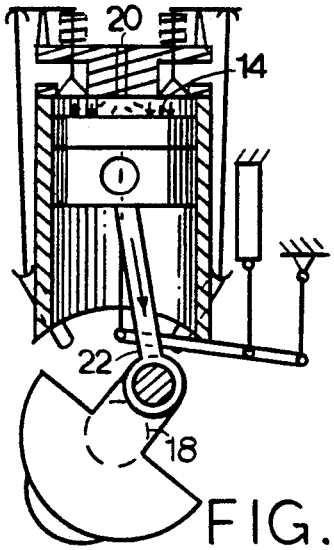
FIGS. 16A–16D schematically depict the four differential strokes of the engine of the present invention.

To describe a typical four-differential-stroke operation of the present invention, reference is now made to schematical FIGS. 16A through D and FIGS. 1 through 15. A peripheral valve cam track 58, preferably about 60 degrees long, is also integrally secured to counterweight 72*b*, next to intake cam track 76 (which is between valve cam track 58 and the central axis of cylinder 12). A pair of intake and exhaust valve lifters 56*a* and 56*b* respectively are connected to a corresponding pair of intake and exhaust push rods 54*a* and 54*b* respectively which are operably connected through corresponding intake and exhaust rocker arms 19*a* and 19*b* respectively to intake and exhaust valves 17*a* and 17*b* respectively. The intake and exhaust lifters 56*a* and 56*b* are placed about 60 degrees apart in the plane of rotation of valve cam track 58, and on opposite sides of the cylinder axis. As crankshaft 18 rotates, valve cam track 58 successively comes in contact with lifters 56*b* and 56*a* and causes them to operate in succession to open and close exhaust and intake valves 17*b* and 17*a* respectively while a piston actuation device 59 synchronized with the crankshaft 18 rotation engages lever bar 26 to make the exhaust (FIG. 16B) and intake (FIG. 16C) stokes of the inner piston part 14*a*. The piston actuation device 59 disengages lever bar 26 and the value cam track 58 swings out of contact during the compression (FIG. 16D) and combustion (FIG. 16A) strokes of the piston parts 14*a* and 14*b*. The piston actuation device 59 can be mechanically powered such as the unsymmetrical cam means described above or alternatively electrically, hydraulically, or pneumatically powered.

Another embodiment provides a variable cycle differential stroke engine wherein a variable cycle control means is provided for the actuation means 59 (in place of or in conjunction with the cammed actuating apparatus to operate the inner piston part). The variable cycle control means of the actuation means 59 provides for the stroke length and/or period to be varied during each engine revolution and from revolution to revolution. Such a variable cycle actuation apparatus may be electrically, pneumatically, or hydraulically powered and the control means of actuation means 59 is preferably a controller similar to digital electronic controllers used on present day automobiles.

Figure 16B:
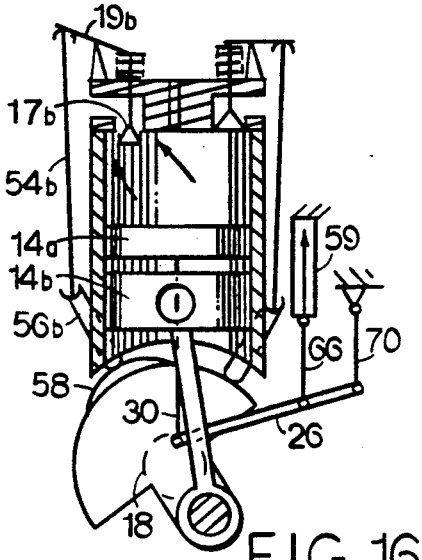
Figure 16C:
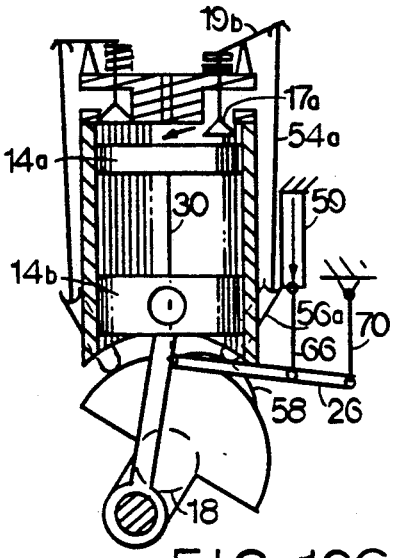
Figure 16D:
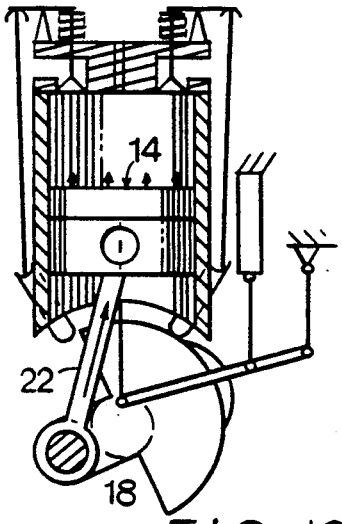
Figure 17A:
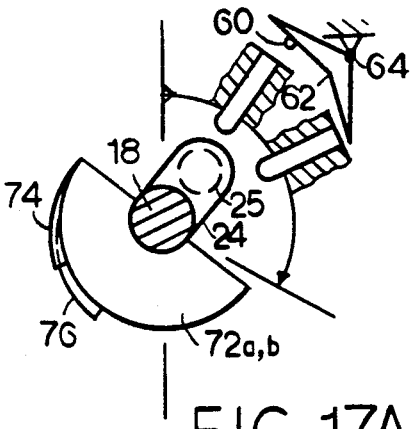
FIGS. 17A–17D schematically correspondingly depict the operation of the rocker assembly during the four strokes of the engine as depicted in FIGS. 16A–16D.
Figure 17B:
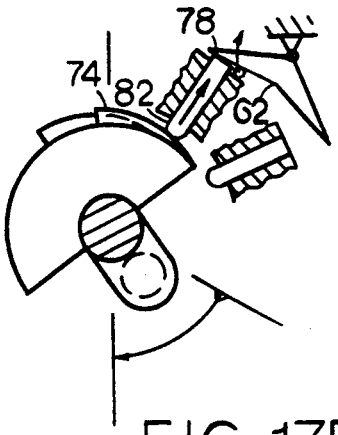
Figure 17C:
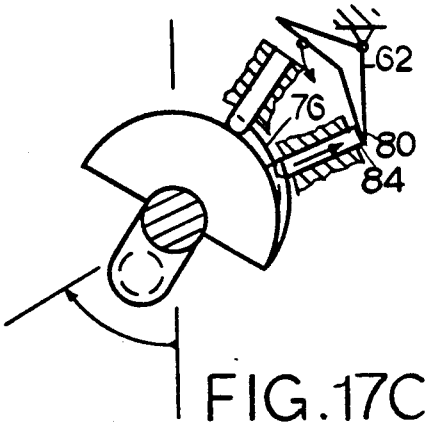
Figure 17D:
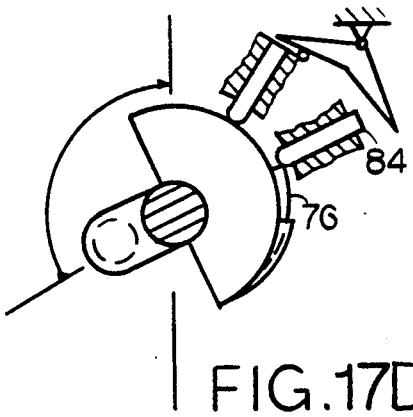

Referring again to the mechanically powered unsymmetrical cam actuation embodiment illustrated in schematic FIGS. 17A through D (which share the same part numbers as FIGS. 1 through 16), at the end of the combustion portion of the cycle, at about $\frac{1}{3}$ of the crank's revolution, valve cam track 58 opens the exhaust valve 17*b* (as described above) and the exhaust cam track 74 swings into engagement with exhaust piston lifter 82 and lifts it to rock exhaust arm 78 and hence rocker assembly 62 in a clockwise direction as particularly shown in FIG. 17B. This causes lever bar 26 to lift stem 30 and inner piston part 14*a* inwardly to expel exhaust gases.from the combustion chamber as shown in FIG. 16B. When inner piston part 14*a* completes its inward movement toward the cylinder head, at about $\frac{1}{2}$ of the crank's revolution, valve cam track 58 closes the exhaust valve 17*b* and opens the intake valve 17*a* (as described above) and the leading profile of intake cam track 76 swings into engagement with intake piston lifter 84 to rock the rocker assembly 62 in a counterclockwise direction, as shown in FIG. 17C, thereby causing lever bar 26 to begin to pull stem 30 and inner piston part 14*a* outwardly to draw a fuel-air mixture into the combustion chamber, as shown in FIG. 16C. At the end of this intake portion of the cycle, at about $\frac{2}{3}$ crank revolution, the leading profile of exhaust cam track 76 swings out of engagement with piston lifter 84, as shown in FIG. 17D, and inner piston part 14*a* comes back into engagement with the rising outer piston part 14*b*, FIG. 16D. Meanwhile, intake valve cam track 58 swings out of engagement with intake valve lifter 56*a* and thereby causes intake valve 17*a* to close. The air fuel mixture in the combustion chamber is then compressed during the compression portion of the cycle as shown in FIG. 16D. During the compression stroke of the cycle, both active leading profiles of the intake and exhaust cam tracks 76 and 74 are out of engagement with intake and exhaust piston lifters 82 and 84. This frees lever bar 26 and allows stem 30 to simply follow inner piston part 14*a* as it is driven by the movement of outer piston part 14*b* which is responsively tied to crank arm 24 by connecting rod 22.

For smoother and quieter operation hydraulic and roller lifters may be used for intake and exhaust valve lifters 56a and 56b, and intake and exhaust piston lifters 82 and 84 on continuous valve cam track 58 and intake and exhaust cam tracks 76 and 74, respectively. In this case, the cam tracks are formed to entirely encircle a disk around crankshaft 18, with variations to cause or accommodate the designed movements of inner piston part 14a and intake and exhaust valves 17a and 17b.

The two intake and exhaust cam tracks 76 and 74 can be replaced by a single piston cam track, if the alternate single piston cam track rocks the rocker assembly 62 in one direction and a spring means or like biasing means is used to rock the rocker assembly 62 in the other direction (up or down).

The cycle description above using FIGS. 16A–16D and 17A–17D divides the four strokes of inner piston part 14a at the 0, $\frac{1}{3}$, $\frac{1}{2}$ and $\frac{2}{3}$ of the crank revolution and without valve timing adjustments. This gives $\frac{1}{3}$ of the crank revolution for each compression and combustion stroke, and the remaining $\frac{1}{3}$ for the breathing strokes equally shared by intake and exhaust strokes. The stroke displacements are equal. This is the typical engines of the invention and is referred to as the typical cycle.

Figures 18, 18A:
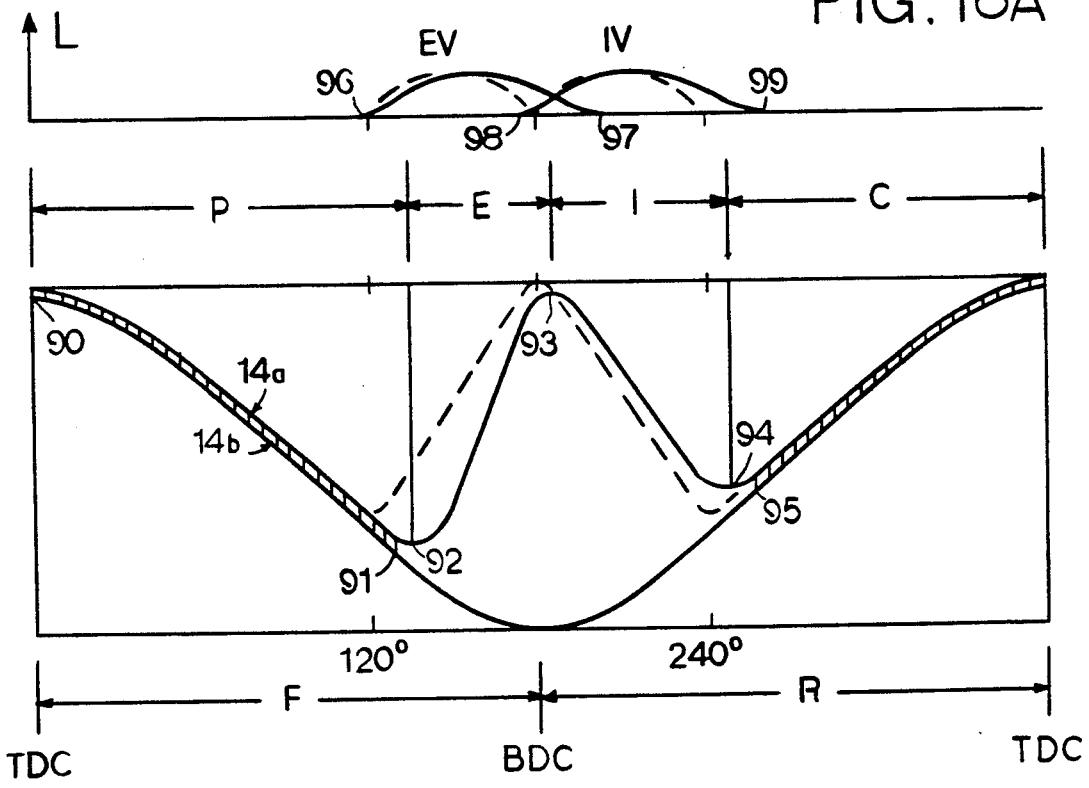
FIG. 18 graphically illustrates an extended power stroke cycle of the invention.
FIG. 18A graphically illustrates the movement of the intake and exhaust valves during the cycle of FIG. 18.

The cycle of engine 10 can be varied within a considerable range from the typical cycle by adjustments of dimensions of the parts and profiles of the cams. For example illustrated in FIG. 18 is a cycle that can readily be achieved for purposes of extended power strokes in which the piston ends its power stroke beyond the position it starts the compression stroke. Such an extended power stroke cycle is graphically depicted in FIG. 18 wherein the vertical ordinate represents the position of the piston parts 14a (upper curve) and 14b (lower curve) in cylinder 12 of FIG. 1A and 1B and the horizontal ordinate represents one crankshaft revolution from 0 to 360 degrees. The 0 degree position represents the starting point of the cycle where the crank arm 24, connecting rod 22 and inner and outer piston parts 14a and 14b are in their extreme inward positions. FIG. 18A graphically illustrates the lift L of the exhaust valve EV and intake valve IV. The typical cycle is shown in dotted lines in FIGS. 18 and 18A for reference purposes.

At the start of the cycle piston parts 14a and 14b are together as indicated in FIG. 18 at 90 and inlet and exhaust valve 17a and 17b are closed as depicted in FIG. 18A. At about the start of the cycle, spark plug 20 is fired or fuel is injected to initiate combustion (for a diesel engine). As schematically illustrated in FIG. 18, outer piston part 14b makes an outward F and a return R inward stroke between its top and bottom dead centers (TDC and BDC) and follows a substantially sinusoidal curve as indicated by the lower curve on the diagram throughout the whole cycle, because of its constant direct linkage to the connecting rod and crank arm. On the other hand, inner piston part 14a makes a power stroke (P), an exhaust stroke (E), an intake stroke (I), and a compression stroke (C) of unequal distances and crankshaft turns. Inner piston part 14a follows the path of travel of outer piston part 14b only during the first and last portions of the cycle as indicated by the shaded portions of the curves in the P and C (the combustion and compression) portions of the cycle. A heavy force is exerted by inner piston part 14a on outer piston part 14b during combustion and a considerable force is exerted by outer piston part 14b on inner piston part 14a during compression.

As shown on the diagram in FIG. 18, inner piston part 14a leaves outer piston part 14b long after $\frac{1}{3}$ of crank revolution to end the combustion stroke and rejoin outer piston part 14b slightly after $\frac{2}{3}$ crank revolution to start the compression stroke. This gives the power stroke longer travel distance than the compression stroke. Cam track 58 is longer than the typical 60 degrees of a typical cycle and positioned to cause the exhaust valve EV to open at substantially the $\frac{1}{3}$ crank turn, which is before the end of the power stroke at position 92 in FIG. 18. This permits the cylinder pressure to blow down before the piston makes the exhaust stroke.

The leading profile of exhaust cam track 74 is shorter than the typical 60 degrees, reaches slightly short of the typical height, and is positioned to engage lifter 82 long after $\frac{1}{3}$ of crankshaft revolution to cause inner piston part 14a to move from position 92 to position 93 in FIG. 18 during the exhaust stroke E depicted. The positions of cam track 58 and intake valve lifter 56a cause the intake valve IV to open at substantially $\frac{1}{2}$ of the crank turn, and before the beginning of the intake stroke and the closing of the exhaust valve EV as illustrated in FIG. 18A. The valve intake and exhaust overlap, depicted by distance between positions 98 and 97 is provided to enhance the intake operation. The longer than typical 60 degrees cam track 58 closes the exhaust valve EV after the $\frac{1}{2}$ crank revolution at position 97. When this portion of the cycle is over, slightly after $\frac{1}{2}$ of crankshaft revolution, intake cam track 76 takes over from exhaust cam track 74 to cause stem 30 to be drawn outwardly during the intake portion of the cycle indicated from position 93 to position 94 in FIG. 18.

Meanwhile, outer piston part 14b has started to return inwardly, beginning exactly from the BDC in the cycle. About $\frac{2}{3}$ through the cycle, exhaust cam track 74 takes back over from intake cam track 76 briefly to initiate a brief return inward movement from position 94 to position 95 in FIG. 18 of inner piston part 14a, in order to cause it to come back into engagement with outer piston part 14b as both are moving at substantially the same speed. Valve cam track 58 delays closing the intake valve IV at position 99 to continue fill the cylinder with in-rushing fuel-air mixture until after the piston 14a initiates the return stroke. Thereafter as well as during the combustion stroke, valve cam track 58 and both exhaust and intake cam tracks 74 and 76 remain disengaged from intake and exhaust valves 17a and 17b and from lever bar 26 so that stem 30 and lever bar 26 can follow passively as piston parts 14a and 14b move together during the combustion and compression portion of the cycle.

As shown in FIG. 18, inner piston part 14a can be made to stop at the end of the exhaust stroke at a level different from where it stops at the end of the compression stroke. This level variation can be zero, as in conventional engines, or slightly shorter to minimize any chance of inner piston part 14a hitting slow responding valves due to inertia at high speeds. The level variation can also be optimized for tuning the intake and the exhaust ducts of the engine to enhance gas exhaust and intake.

Figure 19:
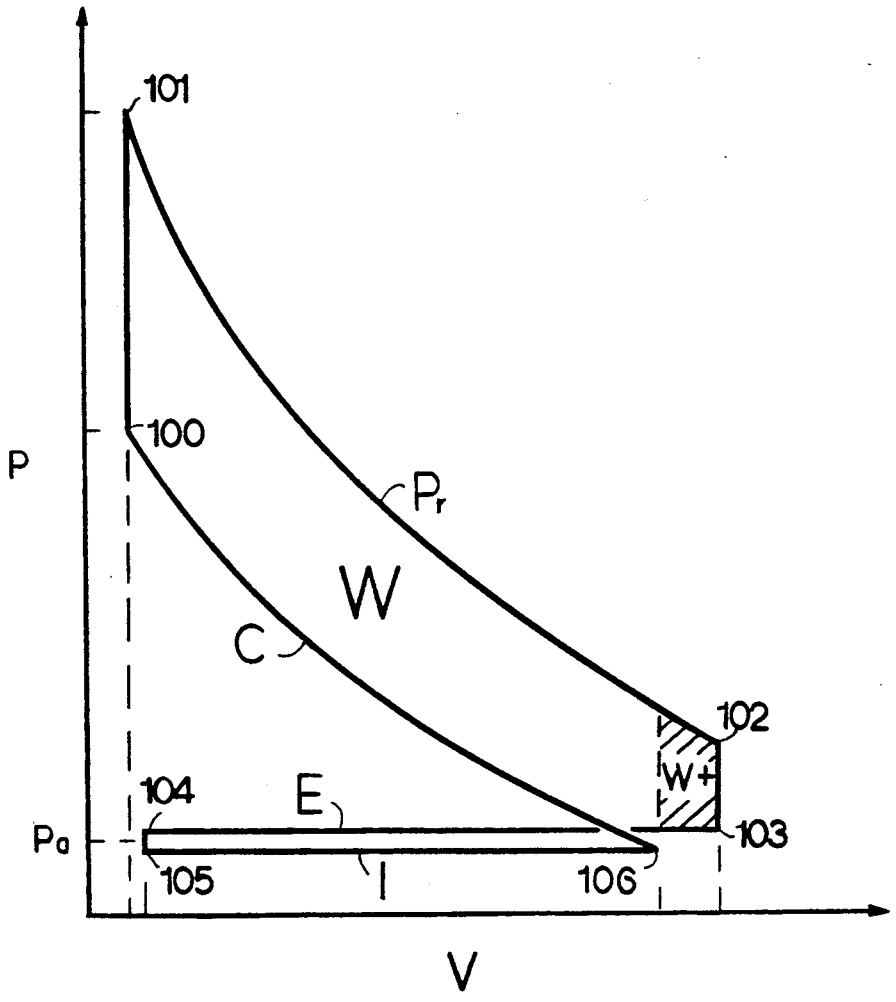
FIG. 19 graphically illustrates the idealized p-V curve of an extended power stroke cycle.

The extended power stroke engine extracts more energy from the same charge than a conventional equal stroke engine, everything else being equal. Illustrated in FIG. 19 is a p-V (pressure p vs volume V) curve for an idealized Otto cycle of such an extended power stroke engine. At the beginning of the cycle, with the intake valve open and exhaust valve closed, a charge is drawn into the cylinder at slightly below ambient pressure Pa during an intake stroke I of the inner piston part 14*a*, depicted from position 105 to position 106. At the end of the intake stroke the intake valve closes at position 106. The inner and outer piston parts make a compression stroke C to compress the charge, which increases the pressure from position 106 to position 100. At the end of the compression stroke at position 100 the spark plug initiates combustion, which produces a pressure surge from position 100 to position 101. The pressure rotates the crankshaft and the inner and outer piston parts make a combustion or power stroke Pr from position 101 to position 102. The outward reach of position 102 of the piston parts extends beyond the beginning position of the compression stroke at position 106. This is an extended power stroke. At the end of the combustion stroke at position 102 the exhaust valve opens and the cylinder pressure drops. The inner piston part 14*a* makes an exhaust stroke at slightly above ambient pressure from position 103 to position 104. Then, the exhaust valve close and intake valve opens to continue the next cycle.

In the idealized thermal cycle, the amount of charge drawn into the cylinder is the volume between positions 105 and 106 and the net work output by the charge is area W. As shown in FIG. 19 area W also includes a shaded area W+ which represents the extra work gained after the inner and outer piston parts in the power stroke Pr expands past the starting position of the compression stroke C. If a piston ends its power stroke at the position it starts the compression (as in a conventional engine), the energy in the shaded area is blown away in the exhaust gas and lost. This is also true for a conventional diesel cycle engine.

The cycle shown in FIGS. 18 and 19 is adapted to extend the power stroke and thus optimize the fuel efficiency of the engine. The invention can also be applied to unlimited number of combinations of stroke lengths and periods, such as extending the intake stroke duration and length in order to optimize the power potential of high speed engines.

While the present preferred embodiments and practices of the invention have been illustrated and described, it will be understood that the invention may be otherwise embodied and practiced within the scope of the following claims.

What is claimed is:

1. A differential stroke piston apparatus for a reciprocating internal combustion engine having at least one cylinder chamber, said differential stroke piston apparatus comprising:

a differential stroke piston effective for reciprocal operation in the engine cylinder chamber, said differential stroke piston having an inner piston part which closes and seals the cylinder chamber and an outer piston part which serves as a carrier for the inner piston part and is connected to an engine shaft, an inner piston part actuation means to operate said inner piston part at an inner piston part cycle different from an outer piston part cycle, and said inner piston part actuation means further comprises a differential stroke control means operable to control a stroke length parameter such that said stroke stroke length parameter has at least two different values during an engine cycle.

2. A differential stroke piston apparatus as claimed in claim 1 wherein said inner piston part actuation means further comprises a variable cycle means.

3. A differential stroke piston apparatus as claimed in claim 1 further comprises:

said outer piston part cycle being a two stroke cycle comprising an outer inward stroke followed by an outer outward stroke during each engine shaft revolution, said inner piston part cycle being a four stroke cycle comprising in order of occurrence compression, power, exhaust, and intake strokes during each engine shaft revolution, and said inner piston part actuation means operable to allow said inner piston part to be carried by said outer piston part during substantially its compression and power strokes.

4. A differential stroke piston apparatus as claimed in claim 3 wherein said differential stroke control means is operable to provide a power stroke length greater than a compression stroke length of said inner piston part cycle.

5. A differential stroke piston apparatus as claimed in claim 3 wherein said differential stroke control means is operable to provide at least one of an intake stroke length and intake stroke period that is greater than at least one of a corresponding one of an exhaust stroke length and exhaust stroke period of said inner piston part cycle.

6. A differential stroke piston apparatus as claimed in claim 1 wherein said inner piston part actuation means includes an unsymmetrical cam means to provide said at least one differential set of said stroke parameters.

7. A differential stroke piston apparatus as claimed in claim 6 wherein said unsymmetrical cam means further comprises a cam mounted on said engine shaft.

8. A differential stroke piston apparatus as claimed in claim 1 wherein said inner piston part actuation means further comprises a lever means including a lever bar operatively connected to said inner piston part such that said inner piston part is operable to provide a load for said lever bar.

9. A differential stroke piston apparatus as claimed in claim 8 wherein said lever means further comprises a fulcrum means having a four-bar linkage including said lever bar.

10. A differential stroke piston apparatus as claimed in claim 9 wherein said inner piston part actuation means includes an unsymmetrical cam means to provide said one differential set of said stroke parameters and said unsymmetrical cam means is operatively connected to said four-bar linkage such that said unsymmetrical cam means is operable to provide a force for said lever bar.

11. A differential stroke piston apparatus as claimed in claim 10 wherein said unsymmetrical cam means further comprises a cam having a cam surface around its periphery, said cam mounted on said engine shaft, a cam rocker means operatively engaged with said cam surface in a cam following manner, and said cam rocker means operatively connected to said four-bar linkage to provide the force for said lever bar.

12. A differential stroke piston apparatus as claimed in claim 8 wherein said inner piston part actuation means further comprises a lever means including a lever bar supported by an accommodating fulcrum means and said lever bar operatively connected at its distal end to said inner piston part such that said inner piston part is operable to provide a load for said lever bar.

13. A differential stroke piston apparatus as claimed in claim 12 wherein said inner piston part actuation means includes an unsymmetrical cam means further comprising an unsymmetrical cam having a cam surface around its periphery, said unsymmetrical cam mounted on said engine shaft, a cam rocker means operatively engaged with said cam surface in a cam following manner, and a cam rocker means operatively connected to said lever means to provide the force for said lever bar.

14. A differential stroke piston apparatus as claimed in claim 1 wherein:

said inner piston part further comprises a stem depending from said inner piston part, said outer piston part further comprises a pin means pivotably connected to said engine shaft by a connecting means, and said stem slidably disposed through said pin means and operably connected at its distal end to said inner piston part actuation means.

15. A differential stroke piston apparatus as claimed in claim 14 further wherein said differential stroke piston further comprises:

a piston part mating means for operably mating said outer piston part to said inner piston part during engine operation so as to allow the outer piston part to effectively serve as a carrier for the inner piston part during at least a portion of said inner and outer piston part cycles, said piston parts mating means comprising conical surface mating elements including;

an inner piston part conical surface mating element having an inner convex conical surface and an outer piston part conical surface mating element having a correspondingly matching outer concave conical surface, and an outer piston part conical surface mating element having an outer convex conical surface and an inner piston part conical surface mating element having a correspondingly matching inner concave conical surface.

16. A differential stroke piston apparatus as claimed in claim 15 further comprising:

said outer piston part having a hollow cylindrical outer skirt slidably disposed within the cylinder, said pin means having a wrist pin attached to said outer skirt, said piston parts mating means further comprising a hub like saddle suspended in the center of said outer skirt by a plurality of struts extending from said saddle to said outer skirt, said saddle having a saddle bore axially extending therethrough, said saddle bore operable to allow said stem to pass through said saddle bore, and said saddle having a bottom surface in bearing contact with said wrist pin.

17. A differential stroke piston apparatus as claimed in claim 14 further comprising:

said outer piston part having a hollow cylindrical outer skirt slidably disposed within the cylinder, said piston parts further comprising a mating means in bearing contact with and substantially suspended in the center of said outer skirt by said pin means.

18. A differential stroke piston apparatus as claimed in claim 17 wherein:

said connecting means further comprises a connecting rod having an upper end bearing and a lower end bearing and said connecting rod is pivotably connected within said hollow cylindrical outer skirt by said pin means, said pin means is disposed through an axial bore of said upper end bearing of said connecting rod, and a notch in said upper end bearing operable to pivotably receive a portion of said mating means.

19. A differential stroke piston apparatus as claimed in claim 14 wherein said pin means includes a wrist pin and said connecting means further comprises:

a connecting rod having an integral upper bearing pivotally connected to said wrist pin, slots disposed in the upper and lower sides respectively of said upper bearing, and said stem is movably disposed through said slots so as allow said stem to pass through said upper bearing as said connecting rod pivots on said wrist pin.

20. A differential stroke piston apparatus as claimed in claim 19 wherein said connecting rod further comprises:

two spaced apart legs integrally connected between said upper end bearing and said lower end bearing which is connected to said engine shaft, and said two spaced apart legs form a space there between wherein said stem and said inner piston part actuation means are operably disposed to pass between said legs within said space.

21. A differential stroke piston apparatus as claimed in claim 8 wherein said inner piston part actuation means further includes a variable cycle means that is operatively connected to said lever bar such that said variable cycle means is operable to provide a force for said lever bar and said variable cycle means includes a control means to vary at least one of said stroke parameters during the engine's operation.

22. A differential stroke piston apparatus as claimed in claim 21 wherein said variable cycle means is an electrically powered actuation means for actuating said lever bar.

23. A differential stroke piston apparatus as claimed in claim 21 wherein said variable cycle means is an hydraulically powered actuation means for actuating said lever bar.

24. A differential stroke piston apparatus as claimed in claim 21 wherein said variable cycle means is a pneumatically powered actuation means for actuating said lever bar.

25. A differential stroke piston apparatus as claimed in claim 1 further comprising an engine control means for operating the engine so as to complete a combustion cycle in the cylinder chamber during one engine shaft revolution, and said control means further comprising a cam on a balancing weight mounted on said engine shaft, said cam operable to actuate intake and exhaust valves.

26. A differential stroke piston apparatus as claimed in claim 2 wherein said variable cycle means further includes an electronic control means to control said inner piston part actuation means.

27. A differential stroke piston apparatus as claimed in claim 2 wherein said variable cycle means is a digital electronic control means to control said inner piston part actuation means.

28. A split piston apparatus for a reciprocating internal combustion engine having at least one engine cylinder chamber, said split piston apparatus comprising:

a split piston effective for reciprocal operation in the engine cylinder chamber;

said split piston having an inner piston part operable to close and seal the cylinder chamber;

said split piston having an outer piston part that is operable as a carrier for the inner piston part during substantially the compression and power strokes of the engine's cycle, and is connected to an engine shaft;

an inner piston part actuation means to operate said inner piston part at an inner piston part cycle different from an outer piston part cycle; and said inner piston part actuation means further comprises a lever means including a lever bar operatively connected to said inner piston part such that said inner piston part is operable to provide a load for said lever bar during the exhaust and intake stokes of the engine's cycle.

29. A split piston apparatus as claimed in claim 28 wherein said inner piston part actuation means further comprises a cam means to help control the stroke length and period of the engine's cycle.

30. A split piston apparatus as claimed in claim 28 wherein said lever means further comprises a fulcrum means having a four-bar linkage including said lever bar.

31. A split piston apparatus as claimed in claim 30 wherein said inner piston part actuation means includes a cam means to control the stroke length and stroke period of said inner piston part cycle and said cam means is operatively connected to said four-bar linkage such that said cam means is operable to provide a force for said lever bar.

32. A split piston apparatus as claimed in claim 31 wherein said cam means further comprises a cam having a cam surface around its periphery, said cam mounted on said engine shaft, a cam rocker means operatively engaged with said cam surface in a cam following manner, and rocker means operatively connected to said four-bar linkage to provide the force for said lever bar.

33. A split piston apparatus as claimed in claim 28 wherein said lever bar is supported by an accommodating fulcrum means and said lever bar is operatively connected at its distal end to said inner piston part such that said inner piston part is operable to provide a load for said lever bar.

34. A split piston apparatus as claimed in claim 29 wherein said cam means further comprises a cam having a cam surface around its periphery, said cam mounted on said engine shaft, a cam rocker means operatively engaged with said cam surface in a cam following manner, and said cam rocker means operatively connected to said lever means to provide the force for said lever bar.

35. A split piston apparatus as claimed in claim 28 wherein:

said inner piston part further comprises a stem depending from said inner piston part, said outer piston part further comprises a pin means pivotably connected to said engine shaft by a connecting means, and said stem slidably disposed through said pin means and operably connected at its distal end to said inner piston part actuation means.

36. A split piston apparatus as claimed in claim 35 wherein said split piston further comprises:

a piston part mating means for operably mating said outer piston part to said inner piston part during engine operation so as to allow the outer piston part to effectively serve as a carrier for the inner piston part during at least a portion of said inner and outer piston part cycles, said piston parts mating means comprising conical surface mating elements including;

an inner piston part conical surface mating element having an inner convex conical surface and an outer piston part conical surface mating element having a correspondingly matching outer concave conical surface, and an outer piston part conical surface mating element having an outer convex conical surface and an inner piston part conical surface mating element having a correspondingly matching inner concave conical surface.

37. A split piston apparatus as claimed in claim 36 further comprising:

said outer piston part having a hollow cylindrical outer skirt slidably disposed within the cylinder, said pin means having a wrist pin attached to said outer skirt, said piston parts mating means further comprising a hub like saddle suspended in the center of said outer skirt by a plurality of struts extending from said saddle to said outer skirt, said saddle having a saddle bore axially extending therethrough, said saddle bore operable to allow said stem to pass through said saddle bore, and said saddle having a bottom surface in bearing contact with said wrist pin.

38. A split piston apparatus as claimed in claim 35 further comprising:

said outer piston part having a hollow cylindrical outer skirt slidably disposed within the cylinder, said piston parts further comprising a mating means in bearing contact with and substantially suspended in the center of said outer skirt by said pin means.

39. A split piston apparatus as claimed in claim 38 wherein:

said connecting means further comprises a connecting rod having an upper end bearing and a lower end bearing and said connecting rod is pivotably connected within said hollow cylindrical outer skirt by said pin means, said pin means is disposed through an axial bore of said upper end bearing of said connecting rod, and a notch in said upper end bearing operable to pivotably receive a portion of said mating means.

40. A split piston apparatus as claimed in claim 35 wherein said pin means includes a wrist pin and said connecting means further comprises:

a connecting rod having an integral upper bearing pivotally connected to said wrist pin, slots disposed in the upper and lower sides respectively of said upper bearing, and said stem is movably disposed through said slots so as allow said stem to pass through said upper bearing as said connecting rod pivots on said wrist pin.

41. A split piston apparatus as claimed in claim 40 wherein said connecting rod further comprises:

two spaced apart legs integrally connected between said upper end bearing and said lower end bearing which is connected to said engine shaft, and said two spaced apart legs form a space there between wherein said stem and said inner piston part actuation means are operably disposed to pass between said legs within said space.

42. A split piston apparatus as claimed in claim 28 wherein said inner piston part actuation means further includes a variable cycle means that is operatively connected to said lever bar such that said variable cycle means is operable to provide a force for said lever bar and said variable cycle means includes a control means to vary at least one inner piston part stroke parameter of a set of inner piston part cycle parameters during the engine's operation wherein said inner piston part cycle parameters include inner piston part stroke length and inner piston part stroke period.

43. A differential stroke piston apparatus for a reciprocating internal combustion engine having at least one cylinder chamber, said differential stroke piston apparatus comprising:

a differential stroke piston effective for reciprocal operation in the engine cylinder chamber, said differential stroke piston having an inner piston part which closes and seals the cylinder chamber and an outer piston part which serves as a carrier for the inner piston part and is connected to an engine shaft;

an inner piston part actuation means to operate said inner piston part at an inner piston part cycle different from an outer piston part cycle, and said inner piston part actuation means further comprises a differential stroke control means operable to control an intake stroke period and an exhaust stroke period to said inner piston part cycle such that said intake stroke and exhaust stroke periods are unequal during an engine cycle.

* * * * *